US006598726B1

(12) United States Patent
Lundblad et al.

(10) Patent No.: US 6,598,726 B1
(45) Date of Patent: Jul. 29, 2003

(54) MACHINE FOR RECEIVING AND ENCLOSING BANK NOTES, WHERE INFORMATION IS PRINTED ON THE INSIDE OF A TRANSPARENT FILM

(75) Inventors: Leif Lundblad, Stockholm (SE); Claes Bjorkman, Stockholm (SE)

(73) Assignee: Nybohov Development AB, Stockholm (SE)

( * ) Notice: Subject to any disclaimer, the term of this patent is extended or adjusted under 35 U.S.C. 154(b) by 0 days.

(21) Appl. No.: 09/787,442

(22) PCT Filed: Oct. 15, 1999

(86) PCT No.: PCT/SE99/01866

§ 371 (c)(1),
(2), (4) Date: Mar. 29, 2001

(87) PCT Pub. No.: WO00/23952

PCT Pub. Date: Apr. 27, 2000

(30) Foreign Application Priority Data

Oct. 22, 1998 (SE) ..... 9803616

(51) Int. Cl.[7] ..... G07F 7/04; B07C 5/00; B66B 61/26

(52) U.S. Cl. ..... 194/206; 53/131.5; 209/534

(58) Field of Search ..... 194/206, 207, 194/302; 209/534; 53/131.4, 131.5, 411

(56) References Cited

U.S. PATENT DOCUMENTS 4,825,378 A * 4/1989 Yuge ..... 209/534
5,031,379 A * 7/1991 Lundblad et al. ..... 53/131.2
5,112,040 A * 5/1992 Johnston et al. ..... 271/106
5,335,484 A * 8/1994 Hain ..... 156/541
5,468,941 A * 11/1995 Sasaki ..... 209/534
5,680,935 A * 10/1997 Mistander et al. ..... 209/534
5,987,431 A * 11/1999 Johnston et al. ..... 209/534

FOREIGN PATENT DOCUMENTS

| | | |
|---|---|---|
| EP | 0653734 | * 11/1994 |
| EP | 0735513 | * 3/1996 |
| EP | 0 871 149 | 10/1998 |
| JP | 405229518 | * 9/1993 |
| JP | 9-169323 | 6/1997 |
| SE | 9501403 | 10/1996 |
| SE | WO 99/67750 | * 12/1999 |

* cited by examiner

*Primary Examiner*—Dean J. Kramer
*Assistant Examiner*—Paul T. Chin
(74) *Attorney, Agent, or Firm*—Jacobson Holman PLLC

(57) ABSTRACT

A banknote handling machine having an infeed part for receiving banknotes deposited by a customer from outside the machine and for identifying the customer, a detector unit for checking the validity of the deposited banknotes, a printing unit for printing information relating to the deposited banknotes and the customer, and a packaging unit for encasing and sealing banknotes suspected of being false in transparent packaging material. Transportation of suspect banknotes to the packaging and printing operations is controlled by a process unit such that customer information and information relating to the suspect banknotes is printed on an inner surface of the transparent packaging material, in mirror-image, in conjunction with operation of the packaging unit to encase and seal the suspect banknotes so that, upon completion, the printed information is properly readable from the outside of the package.

4 Claims, 2 Drawing Sheets

MACHINE FOR RECEIVING AND ENCLOSING BANK NOTES, WHERE INFORMATION IS PRINTED ON THE INSIDE OF A TRANSPARENT FILM

FIELD OF INVENTION

The present invention relates to a banknote handling machine and more specifically to a machine that includes an infeed part for customer identification and for receiving banknotes deposited by the customer from outside the machine, detection means for checking the validity of the deposited banknotes, and means for printing information in respect of customer deposited banknotes.

BACKGROUND OF THE INVENTION

Automatic telling machines that are provided with means for detecting false banknotes are known to the art. Any false banknote that is detected is not returned to the depositing customer, but is stored in the machine and later becomes the subject of a separate investigation.

The procedure undertaken with such an investigation can be relatively complicated and tediously long, which makes it difficult to establish the source of the false banknote, or may make such establishment impossible. The object of the present invention is to endeavour to eliminate the aforesaid drawback and other drawbacks, among other things.

SUMMARY OF THE INVENTION

A banknote handling machine of the aforedescribed kind includes a process unit which functions to control the transportation of a banknote which the detector means suspects to be false, to a separate unit for storing and encasing, packaging, suspected false banknotes, and also controls means for printing customer related information and information relating to any possibly false banknotes detected in conjunction with storing and packaging the suspected false banknote.

BRIEF DESCRIPTION OF THE DRAWINGS

The invention will now be described in more detail with reference to the accompanying schematic drawings, in which.

DESCRIPTION OF PREFERRED EMBODIMENTS

Figure 1:
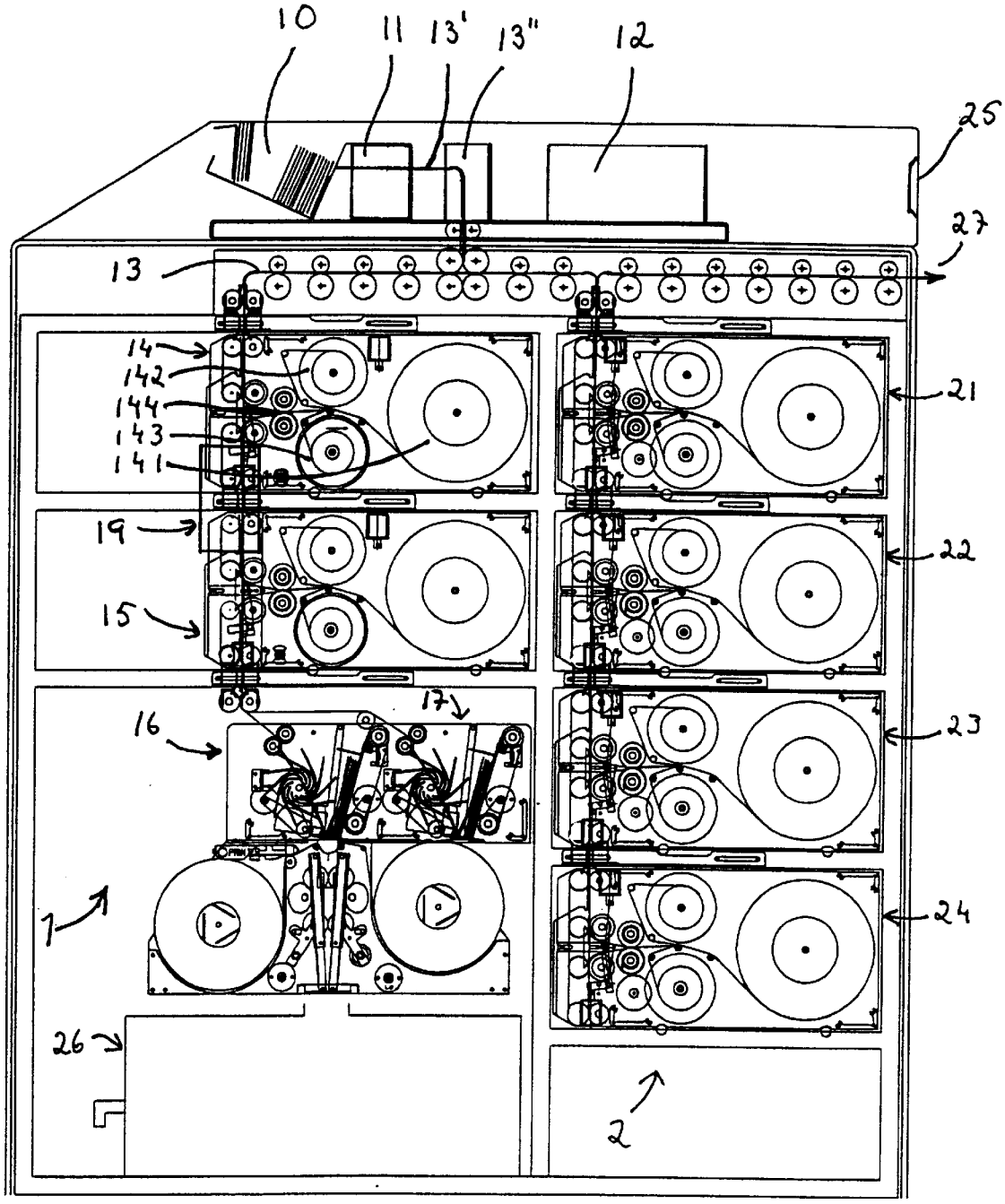
FIG. 1 illustrates an inventive banknote handling machine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The inventive banknote handling machine includes an infeed part 1 and an outfeed part 2.

The infeed part 1 includes a deposit compartment 10, detector means 11, a process unit 12, a conveyor path 13'–13"–13, first storage means 14, second storage means 15, first stacker means 16, second stacker means 17, and a packaging or encasing unit 18.

Banknotes deposited in the machine are bundled and placed into the deposit compartment 10, possibly in different denominations, said compartment accommodating up to 500 banknotes. These banknotes are separated one after the other and conveyed along an upper conveyor path 13', past the detector means 11 and up to guide means (detection changing) 13", which lead the banknotes down to a lower conveyor path 13.

The detector means 11 is placed in the close proximity of the deposit compartment 10 and is adapted to sort false banknotes, poor quality banknotes and other banknotes from the arriving banknotes. By sorting is meant here that passing banknotes are "marked" in some way so that respective banknotes can be handled as being "possibly false", "poor quality" or "accepted" in the subsequent transportation of the banknotes.

The storage device 14, and also other similar storage devices in the machine, has two belts between which banknotes are stored, a storage drum 141 and two unwinding drums 142 and 143. The leading edge of a banknote arriving at the said storage device actuates a sensor 144 which therewith starts-up three motors which each drive a respective drum 141–143. The banknote is drawn about 120 mm in between the belts, which are together wound-up on the storage drum 141, which can accommodate about 500 banknotes. As the belts are coiled on the drum, information relating to the banknotes is sent to the process unit 12, whereby an account can be kept of the sequence between the banknotes. When banknotes are taken from the device 14, impulses are sent to the motors causing the drums to be driven in opposite directions.

A manipulator 19 provided along the conveyor path close to the storage devices 14, 15 functions to correct the positions of any banknotes that may have been twisted or displaced laterally during their transportation.

Each of the stacker device 16, 17 includes a so-called stacker wheel which gathers sequentially arriving banknotes into a bundle in a storage compartments. When the bundle contains the intended number of banknotes, the bundle is clamped by a pair of arms and fed down to the packaging unit 18.

The packaging unit 18 includes two rollers that carry packagin material (plastic material). A banknote bundle to be packaged is drawn down into a pocket that consists of two plastic strips of the same length and width, one from each roll. The plastic strips are pressed together around the bundle and welded along their edges with the aid of a Teflon®-coated heating wire. The reader is referred to U.S. Pat. No. 5,031,379 for a more detailed explanation of this known technique.

The process unit 12 controls the transportation of poor quality banknotes along the conveyor path 13 to the unit 16–18 for storage and packaging of these banknotes. This unit is comprised of the stacker device 16 and the packaging device 18.

The process unit 12 also controls the transportation of at least some of the remaining genuine and accepted banknotes to unit 14–17–18 for storing and packaging these banknotes in accordance with their denominations. This unit is comprised of the storage device 14, the stacker device 17 and the packaging unit 18.

The manner in which the process unit 12 controls the passage of banknotes along different parts of the conveyor path 13 to their different destinations, with the aid of oath selectors, detectors, etc., is known to the art and will not therefore be described in detail here.

Any suspect banknotes encountered in the detector device 11 can be transported to the stacker device 16 for instance, and from there to the packaging unit 18 where they are packaged together with an automatically printed receipt that includes the number of banknotes, the date, etc., and also information relating to the customer depositing the banknotes, e.g. through the medium of an account number. This enables the source of false or suspect banknotes to be investigated.

Figure 2:
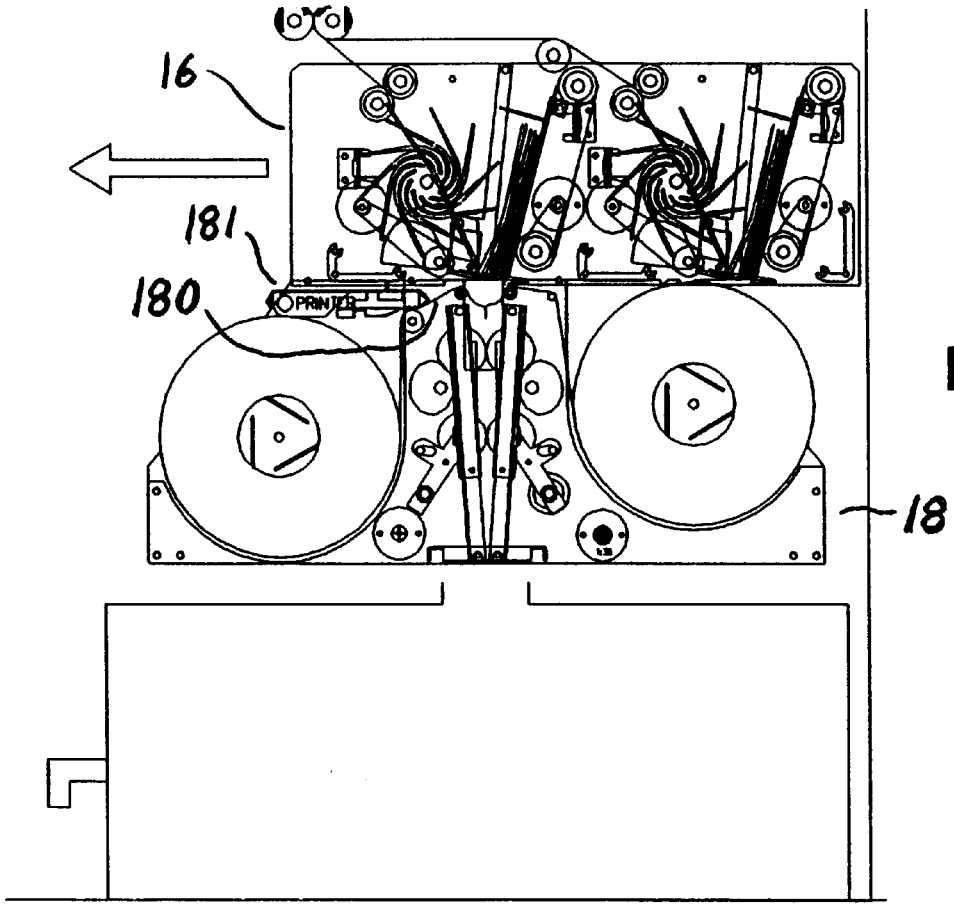
FIG. 2 illustrates in somewhat larger scale a unit for storing and packaging suspected false banknotes included in the machine according to FIG. 1.

FIG. 2 illustrates the stacker device 16 and the packaging device 18 in positions in which they form the unit 16–18 for storing and packaging suspected false banknotes. A printing device 181 is provided for printing directly on the inner surface of packaging material (the plastic strip), in mirror image, customer-related information and information relating to encountered suspect banknotes (preferably several such banknotes). Transportation of the banknote (the banknotes) and printing of said information is controlled by the process unit 12. Thus, in the event of detecting several banknotes that are suspected of being false on one and the same depositing occasion, these banknotes will be collected in one and the same package on which durable information disclosing the contents of the package has been printed.

Figure 3:
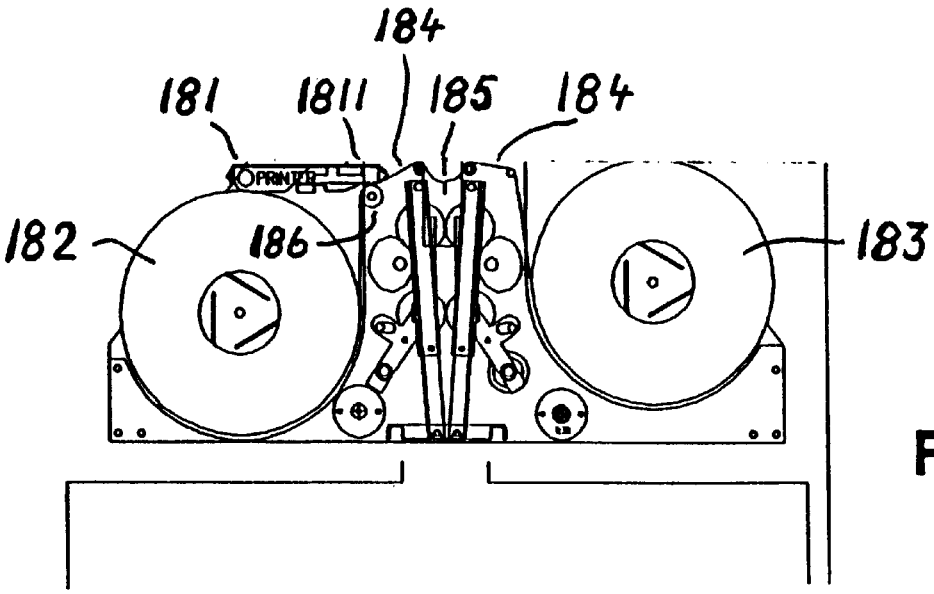
FIG. 3 illustrates a packaging mechanism included in the machine according to FIG. 1.

FIG. 3 illustrates the actual packaging mechanism, including the rolls 182, 183 of plastic packaging material 184. The ends of the material taken from the two rolls are welded together at 185 (after a preceding packaging operation) and form the bottom of a disposable cassette or package for receiving a banknote (banknotes) fed down from above. The printing device 181 is mounted above and close to the roll 182 with the printing head 1811 of said device close to a guide roller 186 and at the upper side of the plastic material 184, this side thus becoming the inside of the package or cassette when a banknote (banknotes) is fed down in between two plastic lengths, one from each roll, and said lengths are then welded together to form a closed package or cassette. It is important that the print is applied close to the weld join 185.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A banknote handling machine comprising:

an infeed part for receiving banknotes deposited by a customer from outside the machine and for identifying the customer;

a detector unit for checking validity of the deposited banknotes;

a printing unit for printing information relating to said deposited banknotes and said customer;

a packaging unit for encasing and sealing banknotes suspected of being false in transparent packaging material; and a process unit for controlling transportation of one or more banknotes suspected of being false by said detector unit to said packaging unit, and for controlling said printing unit for printing customer information and information relating to the suspect banknotes on an inner surface of said transparent packaging material in conjunction with operation of said packaging unit to encase and seal said suspect banknotes.

2. The banknote handling machine as set forth in claim 1, wherein said printing unit is adapted to print the customer and banknote information on an upper side of transparent packaging material immediately prior to a packaging operation, said upper side becoming the inner surface of a closed package produced by said packaging operation such that the information is durable and difficult to manipulate unnoticed.

3. A method of handling banknotes in a banknote handling machine comprising, in the following sequence, the steps of:

receiving banknotes deposited from outside the machine in an infeed part and identifying the customer;

checking validity of the banknotes by a detector unit;

conveying a varied number of checked banknotes suspected of being false banknotes to a packaging unit for encasing banknotes, said step of conveying being controlled by a process unit;

durably printing information relating to said customer and said number of suspected banknotes in mirror image on an inner side of transparent packaging material, said printing being controlled by said process unit; and encasing said number of suspected banknotes with said printed transparent packaging material to form a closed package completely sealing said suspected banknotes such that said printed information on the inner side of said transparent packaging material is readable right-way-up from outside said closed package.

4. The method as set forth in claim 3, further comprising, before the step of printing, the step of farming said closed package by welding two sheets of material at a joint, said printed information being applied adjacent said welded joint.

* * * * *